US010851781B2

(12) United States Patent
Hu et al.

(10) Patent No.: US 10,851,781 B2
(45) Date of Patent: Dec. 1, 2020

(54) COMPRESSOR PUMP STRUCTURE AND COMPRESSOR

(71) Applicant: GREE GREEN REFRIGERATION TECHNOLOGY CENTER CO., LTD. OF ZHUHAI, Zhuhai (CN)

(72) Inventors: Yusheng Hu, Zhuhai (CN); Zhongcheng Du, Zhuhai (CN); Jia Xu, Zhuhai (CN); Liping Ren, Zhuhai (CN); Sen Yang, Zhuhai (CN); Lingchao Kong, Zhuhai (CN); Qingfu Zhao, Zhuhai (CN); Jiakui Xu, Zhuhai (CN); Ning Ding, Zhuhai (CN)

(73) Assignee: GREE GREEN REFRIGERATION TECHNOLOGY CENTER CO., LTD. OF ZHUHAI, Zhuhai (CN)

( * ) Notice: Subject to any disclaimer, the term of this patent is extended or adjusted under 35 U.S.C. 154(b) by 211 days.

(21) Appl. No.: 15/998,582

(22) PCT Filed: Jan. 23, 2017

(86) PCT No.: PCT/CN2017/072199
§ 371 (c)(1),
(2) Date: Aug. 16, 2018

(87) PCT Pub. No.: WO2017/140206
PCT Pub. Date: Aug. 24, 2017

(65) Prior Publication Data

US 2019/0242381 A1 Aug. 8, 2019

(30) Foreign Application Priority Data

Feb. 16, 2016 (CN) ..... 2016 1 0087596

(51) Int. Cl.
*F03C 2/00* (2006.01)
*F03C 4/00* (2006.01)
(Continued)

(52) U.S. Cl.
CPC ..... *F04C 18/34* (2013.01); *F01C 21/0809* (2013.01); *F04C 15/0065* (2013.01);
(Continued)

(58) Field of Classification Search
CPC .. F04B 29/00; F04B 29/0071; F04B 27/0663; F04B 19/025; F04B 39/12;
(Continued)

(56) References Cited

U.S. PATENT DOCUMENTS 3,279,445 A * 10/1966 Karol ..... F01B 13/02 123/44 D
4,723,895 A 2/1988 Hayase

FOREIGN PATENT DOCUMENTS

CN 1546861 A 11/2004
CN 2692379 Y 4/2005
(Continued)

OTHER PUBLICATIONS

Combined Chinese Office Action and Search Report dated May 2, 2017 in corresponding Chinese Patent Application No. 201610087596.2 (with English Translation and English Translation of Category of Cited Documents), 16 pages.
(Continued)

*Primary Examiner* — Theresa Trieu
(74) *Attorney, Agent, or Firm* — Oblon, McClelland, Maier & Neustadt, L.L.P.

(57) ABSTRACT

A compressor pump structure has a cylinder sleeve provided between an upper flange and a lower flange; a cylinder is provided inside the cylinder sleeve; a piston is slidably arranged inside the cylinder; a volume-variable chamber is formed among the cylinder sleeve, the cylinder and the piston; a rotating shaft passes through the piston, the axis of the rotating shaft being eccentrically disposed with respect to the axis of the cylinder with a fixed eccentricity; the
(Continued)

rotating shaft drives the piston and the cylinder to rotate; and the piston slides within the cylinder while rotating so as to change the volume of the volume-variable chamber. Further disclosed is a compressor which comprises a compressor pump structure.

9 Claims, 11 Drawing Sheets

(51) Int. Cl.

| | |
|---|---|
| ***F04C 2/00*** | (2006.01) |
| ***F04C 18/00*** | (2006.01) |
| ***F04C 18/34*** | (2006.01) |
| ***F04C 15/00*** | (2006.01) |
| ***F04C 15/06*** | (2006.01) |
| ***F01C 21/08*** | (2006.01) |
| ***F04C 18/344*** | (2006.01) |
| ***F04C 18/02*** | (2006.01) |
| ***F25B 49/02*** | (2006.01) |
| *F04C 29/02* | (2006.01) |
| *F04C 23/00* | (2006.01) |

(52) U.S. Cl.
CPC ..... *F04C 15/06* (2013.01); *F04C 18/0215* (2013.01); *F04C 18/3445* (2013.01); *F25B 49/02* (2013.01); *F04C 23/008* (2013.01); *F04C 29/023* (2013.01); *F04C 2240/60* (2013.01)

(58) Field of Classification Search
CPC ..... F04B 39/0005; F01B 13/02; F04C 18/34; F04C 18/344; F04C 28/22; F04C 29/0057; F04C 29/0071; F04C 29/02; F04C 29/028; F04C 29/12; F04C 29/128; F04C 29/22; F04C 2240/20; F04C 2240/60; F01C 1/34; F01C 1/344; F01C 20/22; F01C 21/10; F01C 21/108; F01C 21/08
USPC ..... 418/53, 131, 133–134, 255, 259
See application file for complete search history.

(56) References Cited

FOREIGN PATENT DOCUMENTS

| | | | | |
|---|---|---|---|---|
| CN | 2716539 | Y | 8/2005 | |
| CN | 1959114 | A | 5/2007 | |
| CN | 2011-202527 | A | 10/2011 | |
| CN | 203374478 | U | 1/2014 | |
| CN | 204572458 | U | 8/2015 | |
| CN | 204877938 | U | 12/2015 | |
| CN | 204877939 | U | 12/2015 | |
| CN | 204877940 | U | 12/2015 | |
| CN | 105570128 | A | 5/2016 | |
| CN | 205533217 | U | 8/2016 | |
| JP | 6-272671 | A | 9/1994 | |
| JP | 2001-65472 | A | 3/2001 | |
| WO | WO-0136789 | A1 * | 5/2001 | ..... F01B 13/02 |
| WO | WO 2017/140206 | A1 | 8/2017 | |

OTHER PUBLICATIONS

Chinese Office Action dated Sep. 22, 2017 in corresponding Chinese Patent Application No. 201610087596.2 (with English Translation), 8 pages.
International Search Report dated Apr. 28, 2017 in PCT/CN2017/072199, 3 pages.

* cited by examiner

COMPRESSOR PUMP STRUCTURE AND COMPRESSOR

CROSS-REFERENCE TO RELATED APPLICATIONS

This application claims priority to Chinese patent application No. 201610087596.2, filed with Chinese Patent Office on Feb. 16, 2016, entitled "Compressor Pump Structure and Compressor", which is incorporated herein by reference in its entirety.

FIELD OF THE INVENTION

The present disclosure relates to the field of compressors, and in particular, relates to a compressor pump structure and a compressor.

DESCRIPTION OF RELATED ART

In a pump structure of a rotating-cylinder compressor at present, generally a piston bush is mounted coaxially with a cylinder, and subsequently a piston is placed in a piston hole of the piston bush, wherein the piston adopts a non-circular structure for preventing the piston from self-rotation; and both intake and exhaust passages are distributed on a wall of the cylinder.

During operation of the aforementioned rotating-cylinder compressor, there are several problems as follows:

1. A circumferential leaking channel is present between the aforementioned piston bush 2U and cylinder, and is a main leaking channel of the compressor, resulting in lowered performance of the compressor.

2. The aforementioned piston bush needs to be radially spaced during assembly and supported by a short shaft cantilever of a rotating shaft, resulting in a large span of a piston supporting portion of the rotating shaft, and the deformation and contact stress are very large under the action of unit force.

3. With both intake and exhaust passages distributed on a wall of the cylinder, the cylinder is difficult to process and high in processing cost.

4. The outer round contour of the piston includes two arc surfaces and two parallel surfaces distributed therebetween, and a piston hole on the piston bush matched with the piston is also formed by two arc surfaces and two parallel surfaces, resulting in a complex structure and relatively high processing cost of the aforementioned piston and piston bush, and the processing quality is hard to guarantee.

5. A circumferential friction pair between the cylinder and the piston bush is a sliding friction pair, and the linear velocity and the area of the friction pair during operation are very large, so that the frictional power loss of the friction pair is very large, affecting the compressor performance.

SUMMARY OF THE INVENTION

An object of the present disclosure is to provide a compressor pump structure which simplifies the processing technique, facilitates assembly and has no circumferential leaking channel.

Another object of the present disclosure is to provide a compressor which is low in processing cost and high in performance.

To achieve the objects, the present disclosure adopts the following technical solution:

A compressor pump structure includes an upper flange and a lower flange, wherein a cylinder sleeve is provided between the upper flange and the lower flange; a cylinder rotatable about the axis thereof is provided inside the cylinder sleeve; a piston is slidably arranged inside the cylinder; a volume-variable chamber is formed among the cylinder sleeve, the cylinder and the piston;

a rotating shaft passes through the piston, the axis of the rotating shaft being eccentrically disposed with respect to the axis of the cylinder with a fixed eccentricity; the rotating shaft is configured to drive the piston and the cylinder to rotate; and the piston is configured to slide within the cylinder while rotating so as to change a volume of the volume-variable chamber.

In some embodiments, the piston is provided with a slide hole running therethrough; the rotating shaft passes through the slide hole and is configured to drive the piston to slide within the cylinder along a direction perpendicular to the axis of the rotating shaft; and the piston is slidable through the slide hole relative to the rotating shaft.

In some embodiments, outer walls of the piston are provided with two first glide planes arranged in parallel symmetrically with respect to the axis of the piston; inner walls of the slide hole are provided with two parallel second glide planes; and the second glide planes and the first glide planes are arranged perpendicular to each other.

In some embodiments, inner walls of the cylinder are provided with two inner wall planes arranged in parallel symmetrically with respect to the axis of the cylinder; and the inner wall planes are in sliding fit with the first glide planes.

In some embodiments, the cylinder further includes a first cylinder body and a second cylinder body arranged in a step-like manner; the inner wall planes are located on inner walls of the first cylinder body and the second cylinder body; the cylinder sleeve is sleeved outside the first cylinder body and the second cylinder body; the piston is disposed within the first cylinder body and the second cylinder body; the first cylinder body is provided with an opening along an extension direction of two sides of the inner wall planes; and the volume-variable chamber is formed among the opening, the cylinder sleeve and the piston.

In some embodiments, the cylinder sleeve includes a first step hole and a second step hole arranged in a step-like manner, the first cylinder body being located in the first step hole, and the second cylinder body being located in the second step hole.

In some embodiments, a rolling pin retainer assembly is provided between the cylinder and the cylinder sleeve.

In some embodiments, the upper flange is provided with a first intake passage and a first exhaust passage that are configured to periodically communicate with the volume-variable chamber; the volume-variable chamber is configured to suck gas when the first intake passage communicates with the volume-variable chamber; and the volume-variable chamber is configured to discharge gas when the first exhaust passage communicates with the volume-variable chamber.

In some embodiments, the cylinder sleeve is provided with a second intake passage and a second exhaust passage, the second intake passage being communicated with the first intake passage, and the second exhaust passage being communicated with the first exhaust passage.

In another aspect, the present disclosure further adopts the following technical solution:

A compressor includes the aforementioned compressor pump structure.

In the case of the pump structure of the present disclosure, by providing the cylinder sleeve and forming the volume-variable chamber among the cylinder sleeve, the cylinder and the piston, the structure of a piston bush is replaced, and the problem of a circumferential leaking channel is solved, thereby fundamentally reducing the compressor leaking and improving the compressor performance. Furthermore, providing the intake passage and the exhaust passage on the upper flange reduces the processing difficulty of the cylinder and lowers the processing cost. With the rolling pin retainer assembly arranged between the cylinder and the cylinder sleeve, sliding friction between the cylinder and the cylinder sleeve is changed to rolling friction, thereby reducing the friction power loss therebetween and improving the working performance.

The compressor of the present disclosure adopts the aforementioned pump structure, so that the mechanical power loss is lowered, and the performance is obviously improved.

REFERENCE SIGNS

10. upper flange; 20. lower flange; 30. cylinder sleeve; 40. cylinder; 50. piston; 60. rotating shaft; 70. rolling pin retainer assembly; 80. volume-variable chamber; 90. liquid separator assembly; 91. housing assembly; 92. motor assembly; 93. compressor pump structure; 94. upper cover assembly; 95. lower cover assembly; 100. screw; 101. first intake passage; 102. first exhaust passage; 103. upper flange body; 104. upper flange through hole; 105. upper flange screw hole; 106. intake port; 107. exhaust port; 108. exhaust valve assembly; 201 lower flange body; 202. lower flange through hole; 203. lower flange screw hole; 301. first step hole; 302. second step hole; 303. second intake passage; 304. second exhaust passage; 305. cylinder sleeve body; 306. screw hole; 401. first cylinder body; 402. second cylinder body; 403. inner wall plane; 404. opening; 501. slide hole; 502. first glide plane; 503. second glide plane; 504. piston body; 505. arc surface; 601. glide fitting surface; 602. long shaft segment; 603. piston supporting segment; 604. short shaft segment; 605. lubricating oil passage; 6011. oil groove; 6012. oil hole.

DESCRIPTION OF THE INVENTION

Technical solutions of the present disclosure will be further described below in conjunction with the accompanying drawings and specific embodiments.

In description of the present disclosure, it needs to the understood that orientation or position relations denoted by the terms "upper", "lower", "left", "right", "vertical", "horizontal", "inner", "outer" and the like are orientation or position relations based on illustration in the figures, and are only intended to facilitate describing the present disclosure and simplifying description, instead of indicating or implying the denoted devices or elements necessarily have specific orientations or are constructed and operated in specific orientations, and thus they should not be understood as limiting the present disclosure.

Embodiments 1

Figure 1:
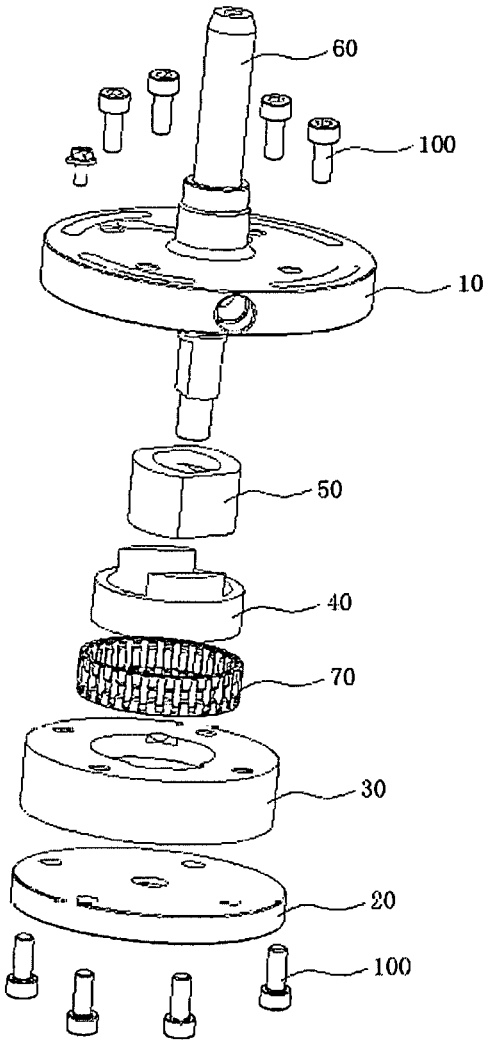
FIG. 1 is an exploded structure diagram of a compressor pump structure in some embodiments 1 of the present disclosure.
Figure 2:
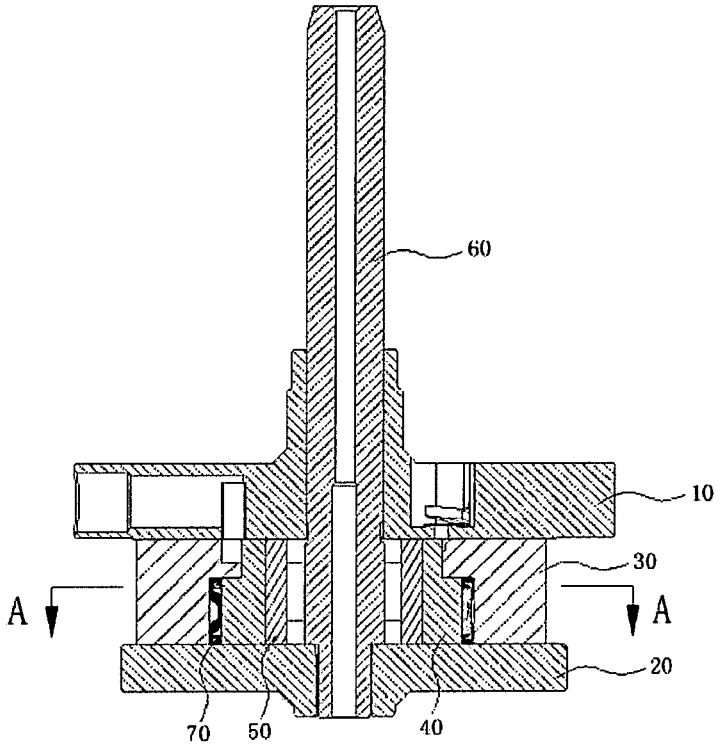
FIG. 2 is an assembly diagram of the compressor pump structure in some embodiments 1 of the present disclosure.
Figure 3:
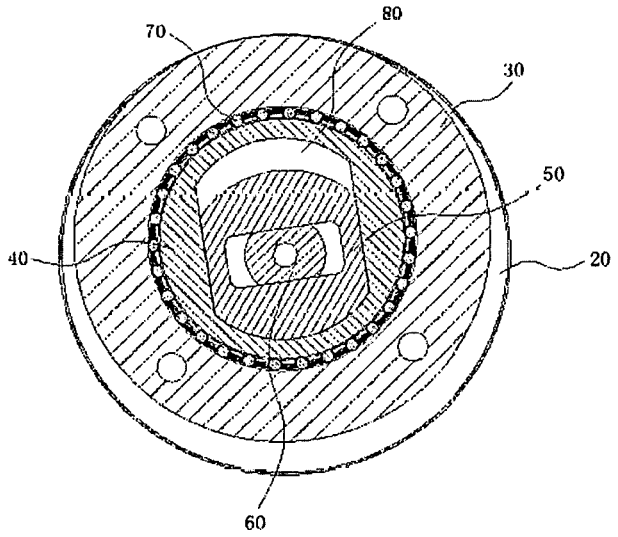
FIG. 3 is a sectional view in a direction A-A of FIG. 2 of the present disclosure.
Figure 4:
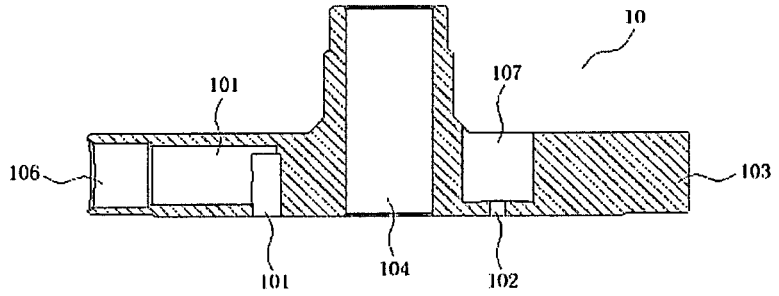
FIGS. 4 to 8 are structural diagrams of an upper flange of the compressor pump structure in some embodiments 1 of the present disclosure.

Some embodiments provide a compressor pump structure, as shown in FIGS. 1 and 2, including an upper flange 10, a lower flange 20, a cylinder sleeve 30, a cylinder 40, a piston 50, a rotating shaft 60 and a rolling pin retainer assembly 70, wherein:

the cylinder sleeve 30 is located between the upper flange 10 and the lower flange 20 and is fixed through screws 100, the cylinder 40 is arranged within the cylinder sleeve 30 rotatably about its axis, and the piston 50 is located in the cylinder 40 and is slidable, but not rotatable, relative to the cylinder 40;

referring to FIG. 3, a volume-variable chamber 80 is formed among the aforementioned cylinder sleeve 30, cylinder 40 and piston 50, and the volume of the volume-variable chamber 80 is variable with sliding of the piston 50;

the rotating shaft 60 passes through the upper flange 10, the piston 50 and the lower flange 20 successively; the axis of the rotating shaft 60 is eccentrically disposed with respect to the axis of the cylinder 40 with a fixed eccentricity. When rotating, the rotating shaft 60 causes the piston 50 to rotate, and the piston 50 causes the cylinder 40 to rotate within the cylinder sleeve 30. While rotating, the aforementioned piston 50 slides within the cylinder 40 along a direction perpendicular to the axis of the rotating shaft 60 to change the volume of the volume-variable chamber 80; and the aforementioned volume-variable chamber 80 rotates with rotation of the cylinder 40 and the piston 50.

In some embodiments, as the axis of the rotating shaft 60 is eccentrically disposed with respect to the axis of the cylinder 40 with a fixed eccentricity, and the rotating shaft 60 and the cylinder 40 rotate about their respective axes during movement thereof, with the mass center being unchanged, thus the piston 50 rotates stably and continuously during movement within the cylinder 40 and ensure regular volume variations of the volume-variable chamber 80, thus improving the performance of the compressor pump.

Referring to FIGS. 4 to 8, the upper flange 10 includes a first intake passage 101, a first exhaust passage 102, an upper flange body 103, an upper flange through hole 104 and and upper flange screw holes 105.

The upper flange body 103 is a disc, and the first intake passage 101 is provided within the upper flange body 103, with one end of the first intake passage running through the lower surface of the upper flange body 103, and the other end being communicated with the outside of the upper flange body 103. During rotation of the cylinder 40 and the piston 50, when the volume-variable chamber 80 rotates to the position of the first intake passage 101, the volume-variable chamber 80 communicates with the first intake passage 101 and sucks gas. In some embodiments, the portion of the first intake passage 101 running through the lower surface of the upper flange body 103 is shaped into an arc hole structure. In some embodiments, an intake port 106 is formed on an outer circumferential wall of the upper flange body 103, and the intake port 106 is communicated with the first intake passage 101.

The first exhaust passage 102 is also provided within the upper flange body 103, and the first exhaust passage and the first intake passage 101 are provided on two sides of the axis of the upper flange body 103 respectively, with one end of the first exhaust passage 102 running through the lower surface of the upper flange body 103, and the other end being communicated with the outside of the upper flange body 103. When the volume-variable chamber 80 rotates to the position of the first exhaust passage 102, the volume-variable chamber 80 communicates with the first exhaust passage 102 and discharges gas. An exhaust port 107 is formed on the upper surface of the upper flange body 103, and the exhaust port 107 is communicated with the first exhaust passage 102.

Figure 5:
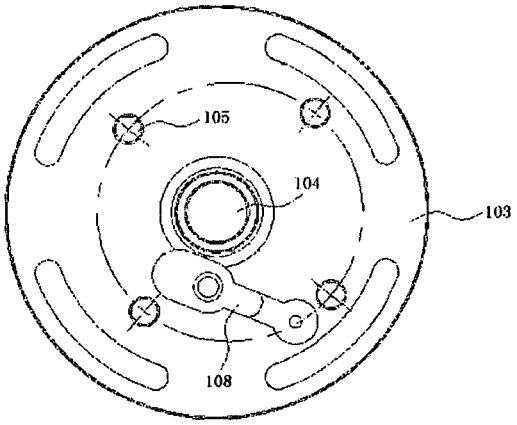
Figure 6:
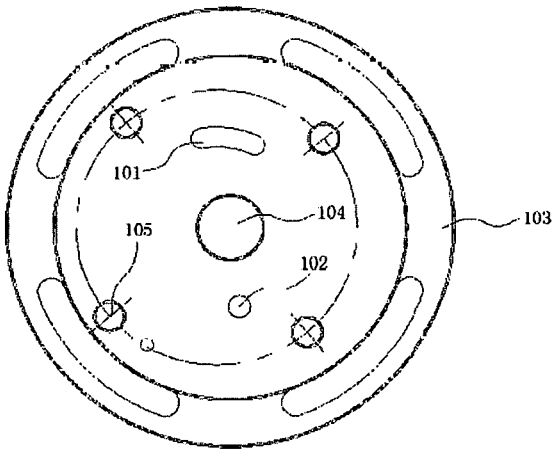
Figure 7:
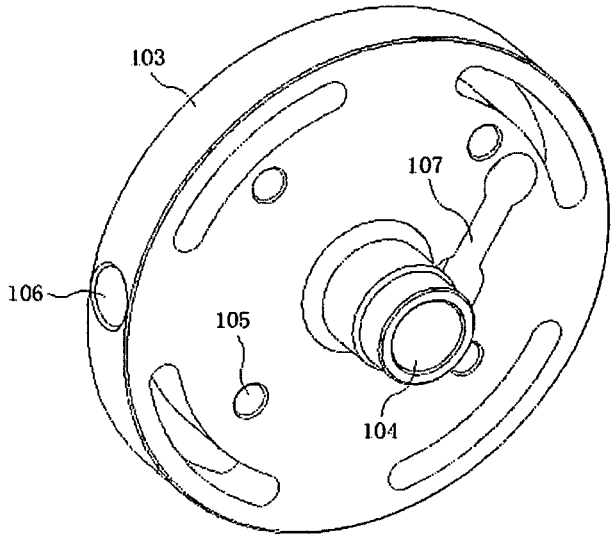
Figure 8:
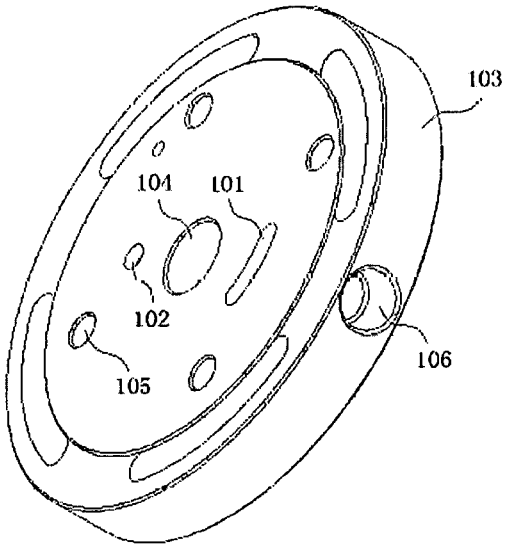

Referring to FIG. 5, an exhaust valve assembly 108 is mounted on the exhaust port 107. The exhaust valve assembly including an exhaust valve plate and a valve plate baffle, which are fixed within a groove of the exhaust port 107 through valve screws (not shown in the figure), so that the valve plate just covers the exhaust port 107, which avoids leakage of a large quantity of gas in the volume-variable chamber 80, thus ensuring the compression efficiency of the volume-variable chamber 80. The exhaust valve assembly 108 in the present disclosure isolates the volume-variable chamber 80 from the outside of the pump structure, which achieves gas discharge by back pressure; that is, after the volume-variable chamber 80 is communicated with the exhaust port 107, when the pressure of the volume-variable chamber 80 is greater than that of the outer space (discharge pressure), the exhaust valve plate is opened to start gas discharge. And if the pressure of the volume-variable chamber 80 is still lower than the discharge pressure after the communication, the exhaust valve plate does not work at that time.

In some embodiments, as the volume-variable chamber 80 rotates with rotation of the cylinder 40 and the piston 50, the volume-variable chamber 80 communicates periodically with the first intake passage 101 and with the first exhaust passage 102, to achieve gas compression by the piston 50.

The upper flange hole 104 is adapted for the rotating shaft 60 to pass through and is coaxially provided at the axis of the upper flange body 103.

A plurality of upper flange screw holes 105 are provided and uniformly distributed circumferentially on the upper flange body 103, and the screws 100 are passed through the upper flange screw holes 105 to fix the upper flange body 103 to the cylinder sleeve 30. In some embodiments, the center of the circle formed by the hole centers of the plurality of upper flange screw holes 105 is arranged eccentrically with respect to the axis of the upper flange body 103, with an eccentricity same as that between the cylinder 40 and the rotating shaft 60.

Figure 9:
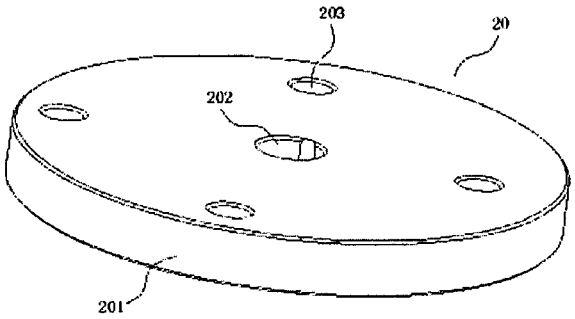
FIG. 9 is a structural diagram of a lower flange of the compressor pump structure in some embodiments 1 of the present disclosure.

Referring to FIG. 9, the lower flange 20 in some embodiments includes a lower flange body 201, a lower flange through hole 202 and lower flange screw holes 203, wherein the lower flange body 201 is a disc which is disposed coaxially with the upper flange body 103, and the lower flange through hole 202 is provided coaxially at the axis of the lower flange body 201, for connecting and supporting the rotating shaft 60.

A plurality of lower flange screw holes 203 are provided and uniformly distributed circumferentially on the lower flange body 201, and the screws 100 are passed through the lower flange screw holes 203 to fix the lower flange body 201 to the cylinder sleeve 30. The center of the circle formed by the hole centers of the plurality of lower flange screw holes 203 is arranged eccentrically with respect to the axis of the lower flange body 201, with an eccentricity same as that between the cylinder 40 and the rotating shaft 60.

Figure 10:
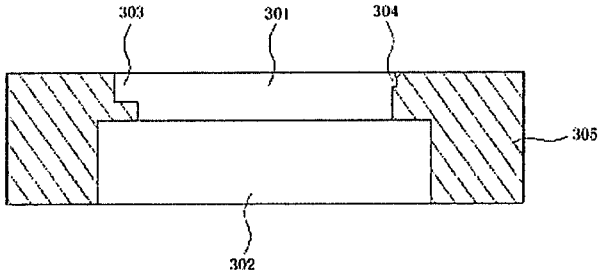
FIGS. 10 to 11 are structural diagrams of a cylinder sleeve of the compressor pump structure in some embodiments 1 of the present disclosure.
Figure 11:
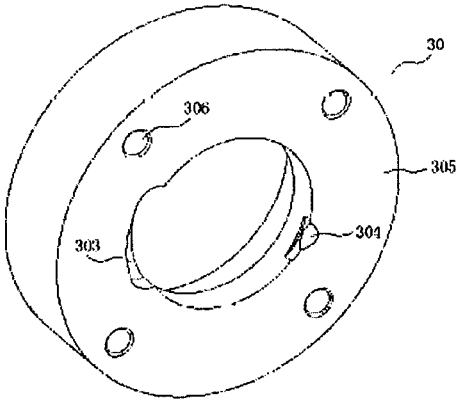

As shown in FIGS. 10 and 11, the cylinder sleeve 30 includes a first step hole 301, a second step hole 302, a second intake passage 303, a second exhaust passage 304, a cylinder sleeve body 305 and screw holes 306.

The first step hole 301 and the second step hole 302 are provided in the cylinder sleeve body 305 in a step-like manner, and the hole centers of the two step holes coincide with the axis of the cylinder sleeve body 305.

The second intake passage 303 is provided on the first step hole 301 and is communicated with the first intake passage 101, so that the volume-variable chamber 80 sucks gas more smoothly.

The second exhaust passage 304 is also provided on the first step hole 301, and the second exhaust passage and the second intake passage 303 are provided on two sides of the hole center of the first step hole 301 respectively; and the second exhaust passage 304 is communicated with the first exhaust passage 102, so that the volume-variable chamber 80 discharges gas more smoothly, which increases the circulation area of the exhaust port 107, thereby reducing the exhaust resistance and improving the work efficiency of the pump structure.

The upper and lower surfaces of the cylinder sleeve body 305 are horizontal surfaces which are closely fit to the upper flange 10 and the lower flange 20.

The screw holes 306 are provided on the upper and lower surfaces of the cylinder sleeve body 305 respectively; and there are a plurality of screw holes 306, which correspond to the positions of the upper flange screw holes 105 and the lower flange screw holes 203 respectively, for fixing the cylinder sleeve 30 to the upper flange 10 and the lower flange 20 through the screws 100.

Figure 12:
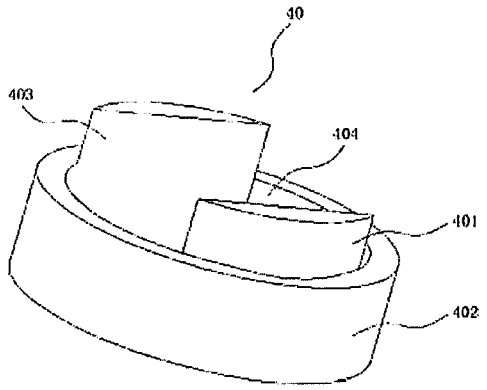
FIG. 12 is a structural diagram of a cylinder of the compressor pump structure in some embodiments 1 of the present disclosure.

Referring to FIG. 12, the cylinder 40 in some embodiments includes a first cylinder body 401, a second cylinder body 402 and inner wall planes 403. The first cylinder body 401 and the second cylinder body 402 are arranged into a step structure; the first cylinder body 401 is located in the first step hole 301, with its outer wall being fit to an inner wall of the first step hole 301, and its upper surface being a horizontal surface and fit to the lower surface of the upper flange 10. The first cylinder body 401 is located on the upper end of the second cylinder body 402, and has two arc blocks. The outer wall diameter of the first cylinder body 401 is equal to the inner wall diameter of the second cylinder body 402.

The second cylinder body 402 is located in the second step hole 302, with its outer wall being fit to an inner wall of the second step hole 302. And its lower surface is a horizontal surface and fits to the upper surface of the lower flange 20.

The inner wall planes 403 are located on inner walls of the first cylinder body 401 and the second cylinder body 402, and are arranged in parallel symmetrically with respect to the axis of the cylinder 40. Specifically the aforementioned inner wall planes 403 run through the first cylinder body 401 and the second cylinder body 402, and the length of the inner wall planes 403 is smaller than the inner wall diameter of the second cylinder body 402.

An opening 404 is provided on two sides of the first cylinder body 401, specifically on the first cylinder body 401 along an extension direction of two sides of the inner wall planes 403. Which are understood as follows: the first cylinder body 401 is imagined as a circular cylinder, and then a middle part of the circular cylinder is cut away. The cut-away width is the distance between the two inner wall planes 403, thus forming the first cylinder body 401 in some embodiments. In some embodiments, the above-mentioned opening 404, the cylinder sleeve 30 and the piston 50 jointly form the volume-variable chamber 80 described above.

Figure 13:
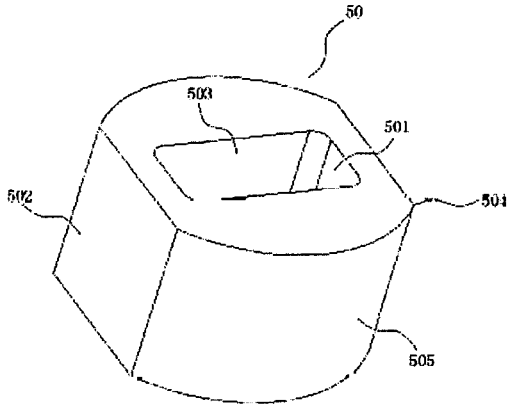
FIG. 13 is a structural diagram of a piston of the compressor pump structure in some embodiments 1 of the present disclosure.

As shown in FIG. 13, the piston 50 is a non-circular structure, such as a square structure. Compared with a piston with a circular structure in the prior art, most of the surfaces of the piston 50 in some embodiments are parallel planes, the processing difficulty of the piston 50 is reduced, and its processing cost is also lowered.

The aforementioned piston 50 includes a slide hole 501, first glide planes 502, second glide planes 503 and a piston body 504, wherein the slide hole 501 is provided in the middle of the piston body 504, with its hole center coinciding with the axis of the piston body 504. The rotating shaft 60 passes through the slide hole 501 and drives the piston 50 to slide within the cylinder 40 in a reciprocating manner along a direction perpendicular to the axis of the rotating shaft 60. The piston 50 slides in a reciprocating manner through the slide hole 501 relative to the rotating shaft 60. In this way, the movement of the piston 50 is reliable, and the problem that the piston 50 gets stuck during movement is effectively avoided. The aforementioned slide hole 501 is provided as an elongated hole or a slotted hole to achieve reciprocating sliding relative to the rotating shaft 60.

Two first glide planes 502 are provided and are both arranged on outer walls of the piston body 504, and are arranged in parallel symmetrically with respect to the axis of the piston body 504. The first glide planes 502 are in sliding fit with the inner wall planes 403; that is, the piston 50 slides in a reciprocating manner along the inner wall planes 403 through the first glide planes 502, which also prevents self-rotation of the piston 50 within the cylinder 40.

Two second glide planes 503 are provided, and are arranged in parallel on two opposite inner walls of the slide hole 501; and the second glide planes 503 and the first glide planes 502 are arranged perpendicular to each other.

The height of the piston body 504 is same as that of the cylinder 40, and the upper and lower surfaces of the piston body 504 are horizontal surfaces fit to the upper flange 10 and the lower flange 20 respectively. The piston body 504 is provided with two arc surfaces 505 adjacent to the first glide planes 502; and the two arc surfaces 505 are in adaptive fit with the inners surfaces of the first cylinder body 401 and the second cylinder body 402.

Figure 14:
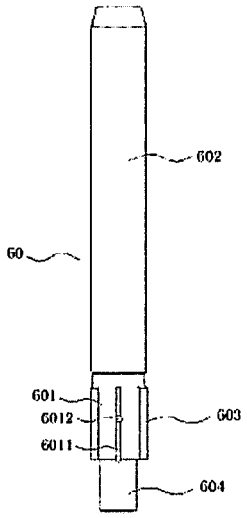
FIGS. 14 to 15 are structural diagrams of a rotating shaft of the compressor pump structure in some embodiments 1 of the present disclosure.
Figure 15:
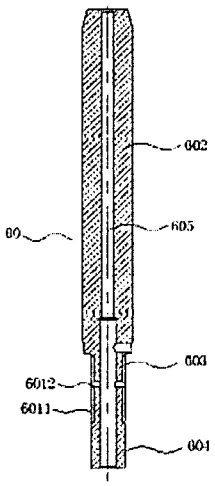

Referring to FIG. 14, the rotating shaft 60 includes a long shaft segment 602, a piston supporting segment 603 and a short shaft segment 604 arranged from top to bottom. One end of the long shaft segment 602 is located outside the upper flange 10, and the other end thereof is located in the upper flange hole 104 of the upper flange 10, with an end surface at the end being flush with the lower surface of the upper flange 10. The length of the short shaft segment 604 is same as the depth of the lower flange through hole 202, and the short shaft segment is disposed in the lower flange through hole 202.

The piston supporting segment 603 is located between the lower surface of the upper flange 10 and the upper surface of the lower flange 20, and is disposed in the slide hole 501 of the piston 50. Glide fitting surfaces 601 are provided in parallel symmetrically on two sides of the piston supporting segment 603, and the glide fitting surfaces 601 are used in cooperation with the second glide planes 503. And when the rotating shaft 60 rotates, the piston 50 slides in a reciprocating manner relative to the rotating shaft 60 through cooperation between the glide fitting surfaces 601 and the second glide planes 503. As the two glide fitting surfaces 601 are arranged symmetrically, the two glide fitting surfaces 601 bear force more uniformly, which ensures the movement reliability of the rotating shaft 60 and the piston 50. The aforementioned glide fitting surfaces 601 are quadrangular, so that when the rotating shaft 60 is rotating, the rotating shaft 60 is prevented from rotating relative to the piston 50.

In some embodiments, the rotating shaft 60 is provided with a lubricating oil passage 605 running therethrough, and the lubricating reliability of the rotating shaft 60 and the piston 50 is ensured through the lubricating oil passage 605. Oil grooves 6011 are formed on the glide fitting surfaces 601, and the oil grooves 6011 are provided with oil holes 6012 formed along the radial direction of the rotating shaft 60. The oil holes 6012 are communicated with the lubricating oil passage 605.

The rolling pin retainer assembly 70 in some embodiments is provided between the cylinder 40 and the cylinder sleeve 30 (referring to FIGS. 1-3), specifically between the second cylinder body 402 and the second step hole 302. The rolling pin retainer assembly 70 is arranged coaxially with the second cylinder body 402. By the rolling pin retainer assembly 70, sliding friction between the cylinder 40 and the cylinder sleeve 30 is changed to rolling friction, thereby greatly reducing the friction power loss and improving the performance of the compressor pump structure.

Figure 16:
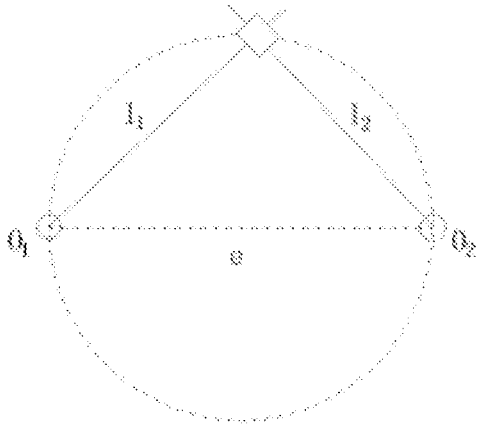
FIG. 16 is a schematic diagram of a cross slider mechanism in some embodiments 1 of the present disclosure.

As shown in FIG. 16, the compressor pump structure in the present disclosure is configured according to the principle of a cross slider mechanism. The axis $O_1$ of the rotating shaft 60 is arranged eccentrically with respect to the axis $O_2$ of the cylinder 40, and the rotating shaft and the cylinder rotate about their respective axis with an eccentricity e being fixed; the distance from the axis of the rotating shaft 60 to the axis of the piston 50 and the distance from the cylinder 40 to the axis of the piston 50 are equivalent to two connecting links $L_1$ and $L_2$ respectively, forming the aforementioned cross slider mechanism.

In some embodiments, the piston 50 serves as a slider in the cross slider mechanism, the glide fitting surfaces 601 of the rotating shaft 60 serve as the first connecting link $L_1$, and the inner wall planes 403 of the cylinder 40 serve as the second connecting link $L_2$, the aforementioned glide fitting surfaces 601 and inner wall planes 403 being perpendicular to each other, thus forming a main body structure of the principle of the cross slider mechanism. When the rotating shaft 60 rotates, the piston 50 performs rectilinear reciprocating sliding relative to the rotating shaft 60 and the cylinder 40 to achieve gas compression, and the piston 50 as a whole rotates synchronously with the rotating shaft 60, and the piston 50 moves within the eccentric distance e relative to the axis of the cylinder 40. After the piston 50 is simplified into a mass center, it is found that its motion trajectory embodies circular motion, with the distance between the axis $O_2$ of the cylinder 40 and the axis $O_1$ of the rotating shaft 60 being the diameter of the circle (i.e. the eccentric distance e).

In some embodiments, the travel distance of the piston 50 is 2e, the cross-section area of the piston 50 is S, and the compressor displacement (i.e. maximum intake volume) is $V=2\times(2e\times S)$.

The composite movement of such a cross slider mechanism enables the piston 50 to reciprocate relative to the cylinder 40, and the reciprocating movement enables the aforementioned volume-variable chamber 80 to become bigger and smaller periodically. The cylinder 40 rotates relative to the cylinder sleeve 30, so that the volume-variable chamber 80 periodically communicate with the first intake passage 101 and the first exhaust passage 102. Under the combined action of the two types of relative movement, the compressor pump structure of some embodiments accomplishes gas intake, compression and exhaust processes.

An intake-exhaust process of the volume-variable chamber 80 in some embodiments is described below.

Figure 17:
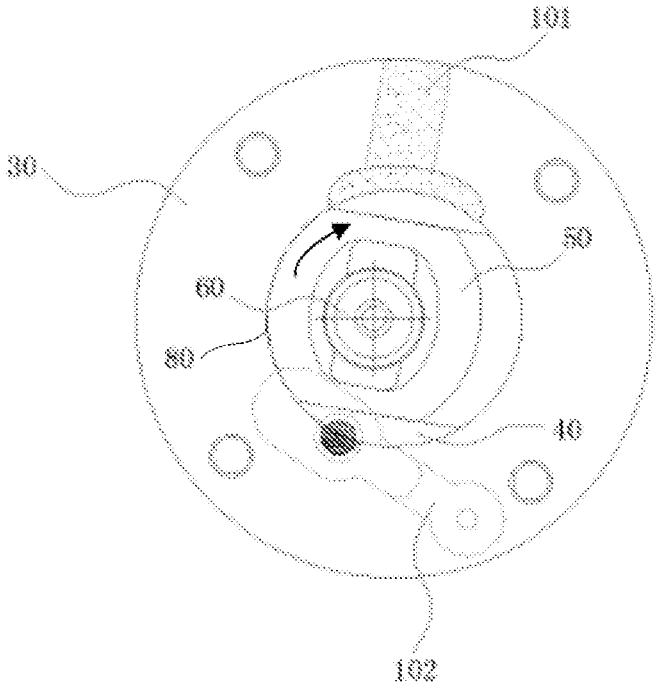
FIG. 17 is a schematic diagram of a working state in some embodiments 1 of the present disclosure when the piston is ready for intake.
Figure 18:
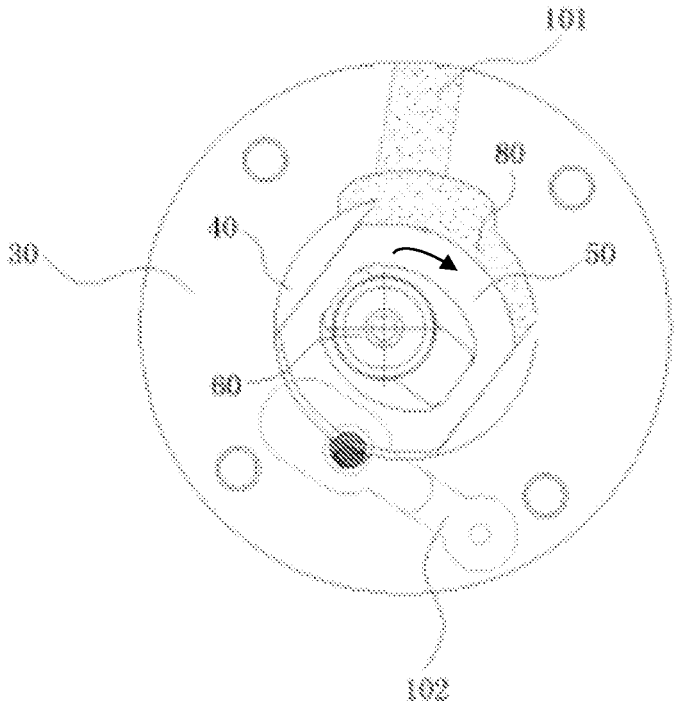
FIG. 18 is a schematic diagram of a working state in some embodiments 1 of the present disclosure when the piston is an intake process.
Figure 19:
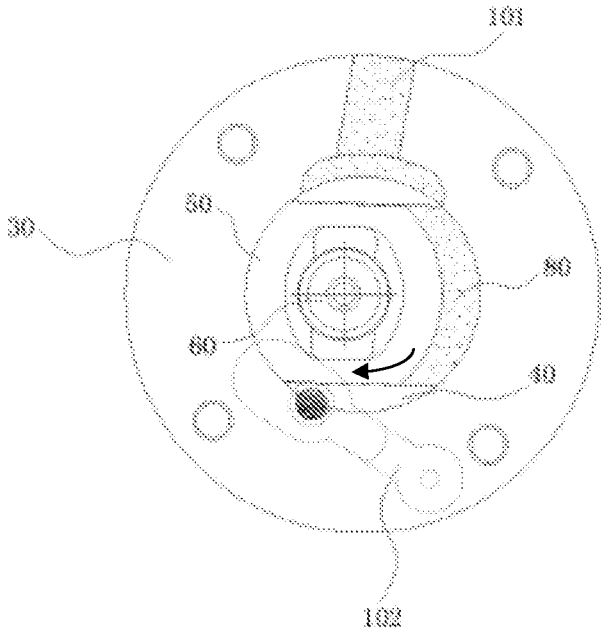
FIG. 19 is a schematic diagram of a working state in some embodiments 1 of the present disclosure when the piston has completed gas intake and starts compression.
Figure 20:
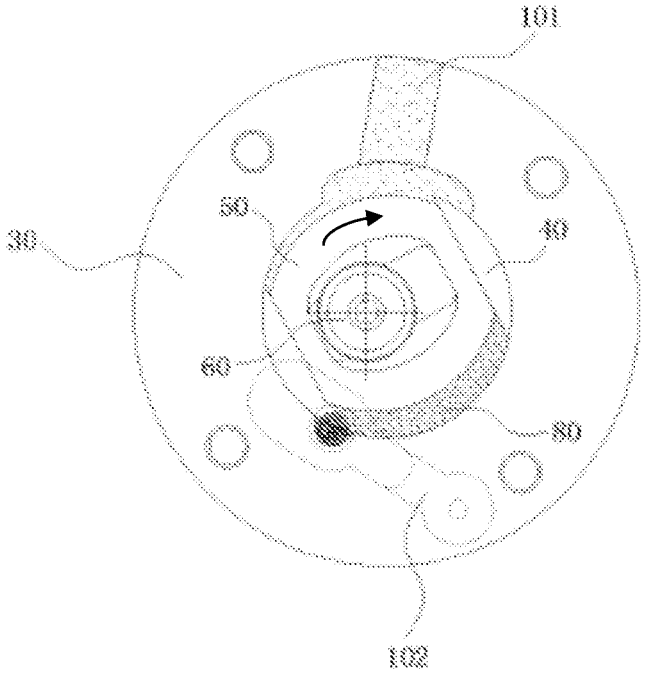
FIG. 20 is a schematic diagram of a working state in some embodiments 1 of the present disclosure when the piston is compressing and discharging gas.
Figure 21:
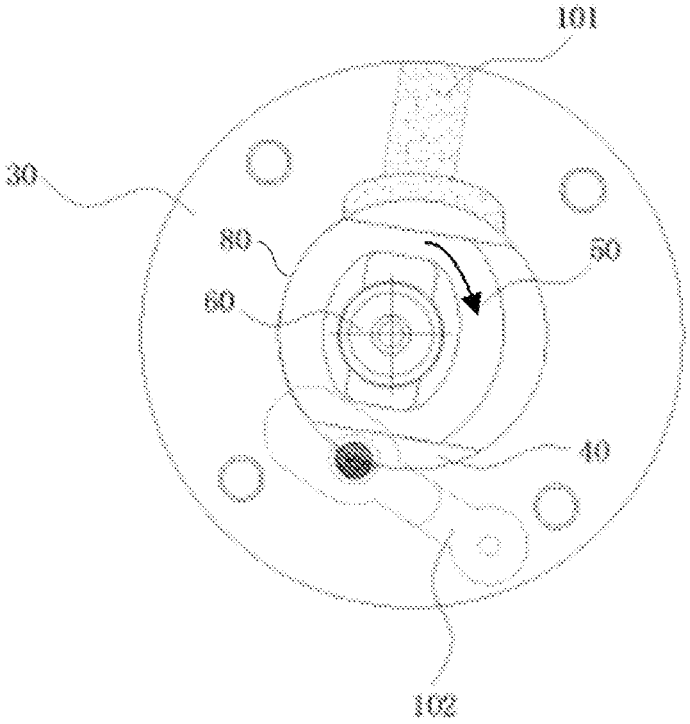
FIG. 21 is a schematic diagram of a working state in some embodiments 1 of the present disclosure when the piston has completed gas discharge.

As shown in FIG. 17, the volume-variable chamber 80 is in a non-intake state. With rotation of the rotating shaft 60, the volume-variable chamber 80 rotates to a position of communicating with the first intake passage 101, and the volume-variable chamber 80 begins sucking gas (shown in FIG. 18). And when the rotating shaft 60 continues to drive the piston 50 and the cylinder 40 to rotate, the volume-variable chamber 80 rotates and separates from the first intake passage 101, and the gas therein starts to be compressed by the piston 50 (i.e. the piston 50 slides in the cylinder 40 to change the volume of the volume-variable chamber 80 and compresses the gas therein (as shown in FIG. 19). Subsequently the rotating shaft 60 continue rotating, and when the volume-variable chamber 80 rotates into communication with the first exhaust passage 102, the gas therein is discharged through the first exhaust passage 102 (as shown in FIG. 20). And the rotating shaft 60 continue rotating, and the volume-variable chamber 80 separates from the first exhaust passage 102, and the gas in the volume-variable chamber 80 is completely discharged, thus completing the discharge process (as shown in FIG. 21). Subsequently the next intake and exhaust cycle is implemented.

Embodiments 2

Figure 22:
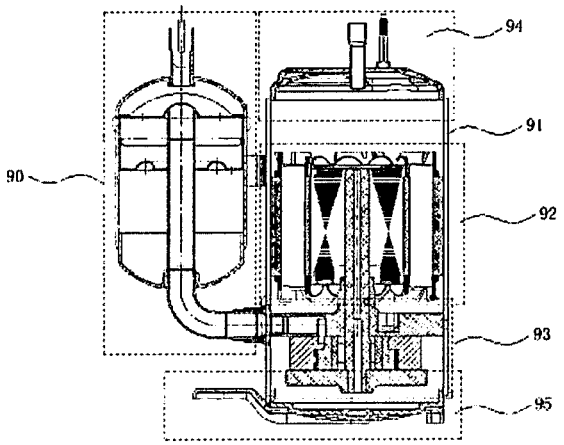
FIG. 22 is a structural diagram of a compressor in some embodiments 2 of the present disclosure.

Some embodiments provide a compressor, including the compressor pump structure in the embodiments 1. As shown in FIG. 22, the compressor including a liquid separator assembly 90, a housing assembly 91, a motor assembly 92, a compressor pump structure 93, an upper cover assembly 94 and a lower cover assembly 95. The liquid separator assembly 90 is arranged outside of the housing assembly 91 and is communicated with the first intake passage 101 of the upper flange 10 of the compressor pump structure 93. The upper cover assembly 94 is assembled at the upper end of the housing assembly 91. The lower cover assembly 95 is assembled at the lower end of the housing assembly 91. The motor assembly 92 and the compressor pump structure 93 are both located within the housing assembly 91. The motor assembly 92 is arranged above the compressor pump structure 93. A motor output end of the motor assembly 92 is connected to the rotating shaft 60 and causes the rotating shaft 60 to rotate.

In some embodiments, during a circle of movement of the piston 50 of the compressor pump structure 93, gas sucking and gas discharging are performed twice respectively, so that the compressor has high compression efficiency. As compared with a single-cylinder roller compressor with the same displacement, as the original once-compression is divided into twice-compression, the compressor in the present disclosure has relatively small moment fluctuations and has the advantage of small exhaust resistance during operation, and exhaust noise is effectively avoided.

Obviously, the foregoing embodiments of the present disclosure are only examples for clearly illustrating the present disclosure, and are not intended to limit the implementations of the present disclosure. For those of ordinary skill in the art, other variations or modifications in different forms are also made based on the above description. It does not need and is impossible here to list all implementations in an exhaustive way. Any modification, equivalent substitution, improvement and the like made within the spirit and principle of the present disclosure shall be encompassed within the protection scope of the claims of the present disclosure.

The invention claimed is:

1. A compressor pump structure, comprising:

an upper flange;

a lower flange;

a cylinder sleeve provided between the upper flange and the lower flange;

a cylinder rotatable about an axis thereof is provided inside the cylinder sleeve;

a piston slidably arranged inside the cylinder, a volume-variable chamber is formed among the cylinder sleeve, the cylinder and the piston;

a rotating shaft passes through the piston, an axis of the rotating shaft being eccentrically disposed with respect to the axis of the cylinder with a fixed eccentricity, the rotating shaft is configured to drive the piston and the cylinder to rotate, and the piston is configured to slide within the cylinder while rotating so as to change a volume of the volume-variable chamber, wherein the cylinder includes a first cylinder body and a second cylinder body arranged in a step-like manner, wherein the cylinder sleeve includes a first step hole and a second step hole arranged in a step-like manner, and wherein the first cylinder body being located in the first step hole, and the second cylinder body being located in the second step hole.

2. The compressor pump structure of claim 1, wherein the piston is provided with a slide hole running therethrough, wherein the rotating shaft passes through the slide hole and is configured to drive the piston to slide within the cylinder along a direction perpendicular to the axis of the rotating shaft, and wherein the piston is slidable through the slide hole relative to the rotating shaft.

3. The compressor pump structure of claim 2, wherein outer walls of the piston are provided with two first glide planes arranged in parallel symmetrically with respect to the axis of the piston, wherein inner walls of the slide hole are provided with two parallel second glide planes, and wherein the second glide planes and the first glide planes are arranged perpendicular to each other.

4. The compressor pump structure of claim 3, wherein inner walls of the cylinder are provided with two inner wall planes arranged in parallel symmetrically with respect to the axis of the cylinder, and wherein the inner wall planes are in sliding fit with the first glide planes.

5. The compressor pump structure of claim 4, wherein the inner wall planes are located on inner walls of the first cylinder body and the second cylinder body, wherein the cylinder sleeve is sleeved outside the first cylinder body and the second cylinder body, wherein the piston is disposed within the first cylinder body and the second cylinder body, the first cylinder body is provided with an opening along an extension direction of two sides of the inner wall planes, and wherein the volume-variable chamber is formed among the opening, the cylinder sleeve and the piston.

6. The compressor pump structure of claim 1, wherein a rolling pin retainer assembly is provided between the cylinder and the cylinder sleeve.

7. The compressor pump structure of claim 1, wherein the upper flange is provided with a first intake passage and a first exhaust passage that are configured to periodically communicate with the volume-variable chamber, wherein the volume-variable chamber is configured to suck gas when the first intake passage communicates with the volume-variable chamber, and wherein the volume-variable chamber is configured to discharge gas when the first exhaust passage communicates with the volume-variable chamber.

8. The compressor pump structure of claim 7, wherein the cylinder sleeve is provided with a second intake passage and a second exhaust passage, the second intake passage being communicated with the first intake passage, and the second exhaust passage being communicated with the first exhaust passage.

9. A compressor, comprising the compressor pump structure of claim 1.

* * * * *